US012280417B2

(12) United States Patent
Hu et al.

(10) Patent No.: US 12,280,417 B2
(45) Date of Patent: Apr. 22, 2025

(54) METHOD FOR PROCESSING HEAT EXCHANGER AND PUSHING DEVICE FOR PROCESSING HEAT EXCHANGER

(71) Applicant: SANHUA (HANGZHOU) MICRO CHANNEL HEAT EXCHANGER CO., LTD., Zhejiang (CN)

(72) Inventors: Qiong Hu, Zhejiang (CN); Zheng Wei, Zhejiang (CN); Yue Zhang, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 30 days.

(21) Appl. No.: 18/286,877

(22) PCT Filed: Apr. 15, 2022

(86) PCT No.: PCT/CN2022/087208
§ 371 (c)(1),
(2) Date: Oct. 13, 2023

(87) PCT Pub. No.: WO2022/218428
PCT Pub. Date: Oct. 20, 2022

(65) Prior Publication Data

US 2024/0226991 A1 Jul. 11, 2024

(30) Foreign Application Priority Data

Apr. 16, 2021 (CN) ..... 202110413029.2

(51) Int. Cl.
*B21D 53/06* (2006.01)
*F28D 1/04* (2006.01)
(Continued)

(52) U.S. Cl.
CPC ..... *B21D 53/06* (2013.01); *F28D 1/0476* (2013.01); *F28F 1/025* (2013.01)

(58) Field of Classification Search
CPC ..... B21D 53/06; F28D 1/0476; F28D 1/0471; F28D 1/0435; F28F 1/025; F28F 1/126; F28F 1/20
See application file for complete search history.

(56) References Cited

U.S. PATENT DOCUMENTS

2020/0132378 A1* 4/2020 Dong ..... F28D 1/0391
2023/0314085 A1* 10/2023 Wang ..... F28D 1/0471 165/175
2023/0332844 A1* 10/2023 Wang ..... F28F 1/32

FOREIGN PATENT DOCUMENTS

CN 210321335 U * 4/2020
CN 213120167 U * 5/2021
(Continued)

OTHER PUBLICATIONS

Liu Liyan, "International Search Report for PCT Application No. PCT/CN2022/087208", Jul. 4, 2022, ISA, China.

*Primary Examiner* — Bayan Salone
(74) *Attorney, Agent, or Firm* — Bridgeway IP Law Group, PLLC; Jihun Kim

(57) ABSTRACT

A method for processing a heat exchanger includes: providing a heat exchange, in which a bent section of one heat exchange tube in the heat exchanger is at least partially in contact with a bent section of another heat exchange tube adjacent to it in a length direction of the first tube; placing the pushing member, such that the pushing member is at least partially in contact with a bent section of at least one heat exchange tube; moving the pushing member, and/or moving the heat exchange tube to enable the bent section to rotate by a predetermined angle or move by a predetermined distance relative to a first section connected with it, such that
(Continued)

the bent section of one heat exchange tube is not in contact with the bent section of the other heat exchange tube adjacent to it in the length direction of the first tube.

20 Claims, 18 Drawing Sheets

(51) Int. Cl.

| | |
|---|---|
| ***F28D 1/047*** | (2006.01) |
| ***F28F 1/02*** | (2006.01) |
| *F28F 1/12* | (2006.01) |
| *F28F 1/20* | (2006.01) |
| *F28F 19/00* | (2006.01) |

(56) References Cited

FOREIGN PATENT DOCUMENTS

| | | | | | |
|---|---|---|---|---|---|
| CN | 113732198 | A * | 12/2021 | ..... | B21D 11/14 |
| WO | WO-2021244433 | A1 * | 12/2021 | ..... | B21D 11/14 |
| WO | WO-2022041250 | A1 * | 3/2022 | ..... | B21D 11/00 |

* cited by examiner

METHOD FOR PROCESSING HEAT EXCHANGER AND PUSHING DEVICE FOR PROCESSING HEAT EXCHANGER

CROSS-REFERENCE TO RELATED APPLICATIONS

This application a national phase entry under 35 USC § 371 of International Application PCT/CN2022/087208, filed Apr. 15, 2022, which claims the priority of Chinese Patent Application No. 202110413029.2 filed on Apr. 16, 2021, the entire contents of which are incorporated herein by reference.

FIELD

The present disclosure relates to the field of heat exchange, in particular to a method for processing a heat exchanger and a pushing device for processing a heat exchanger.

BACKGROUND

Micro-channel heat exchangers are widely used in the field of air conditioning. In the related art, micro-channel heat exchangers include a plurality of heat exchange tubes. In order to increase the heat exchange area, the heat exchange tubes will be twisted and bent to form two or more rows of heat exchangers, so that the bent parts of adjacent heat exchange tubes will butt or overlap locally.

SUMMARY

A method for processing a heat exchanger according to embodiments of the present disclosure includes: providing the heat exchanger, in which the heat exchanger includes a first tube, a second tube and a plurality of heat exchange tubes, the plurality of heat exchange tubes communicates the first tube with the second tube, each heat exchange tube includes a first section, a second section and a bent section, the bent section has a first end connected with the first section and a second end connected with the second section, the bent section of the heat exchange tube includes a twisted section, the first sections of the plurality of heat exchange tubes are arranged at intervals along a length direction of the first tube, the second sections of the plurality of heat exchange tubes are arranged at intervals along the length direction of the first tube, before processing of the heat exchanger, the bent section of one heat exchange tube is in contact with at least part of the bent section of another heat exchange tube adjacent to the one heat exchange tube in the length direction of the first tube: placing a pushing member so that at least part of the pushing member contacts at least part of the bent section of at least one heat exchange tube: moving the pushing member to drive the bent section to rotate by a predetermined angle or move by a predetermined distance relative to the first section connected with the bent section, and/or moving the bent section of the heat exchange tube so that the bent section rotates by a predetermined angle or moves by a predetermined distance relative to the first section connected with the bent section, so that after the processing, the bent section of one heat exchange tube is not in contact with the bent section of the heat exchange tube adjacent to the one heat exchange tubes in the length direction of the first tube.

A pushing device for processing a heat exchanger, in which the heat exchanger includes a heat exchange tube, the heat exchange tube includes a first section, a second section and a bent section, the bent section has a first end connected with the first section and a second end connected with the second section, the pushing device is configured to push the bent section of the heat exchange tube to rotate by a predetermined angle or move by a predetermined distance, and the pushing device includes a pushing member. The pushing member includes an outer surface, and surface hardness of at least part of the outer surface is less than or equal to surface hardness of the heat exchange tube.

Figure 1:
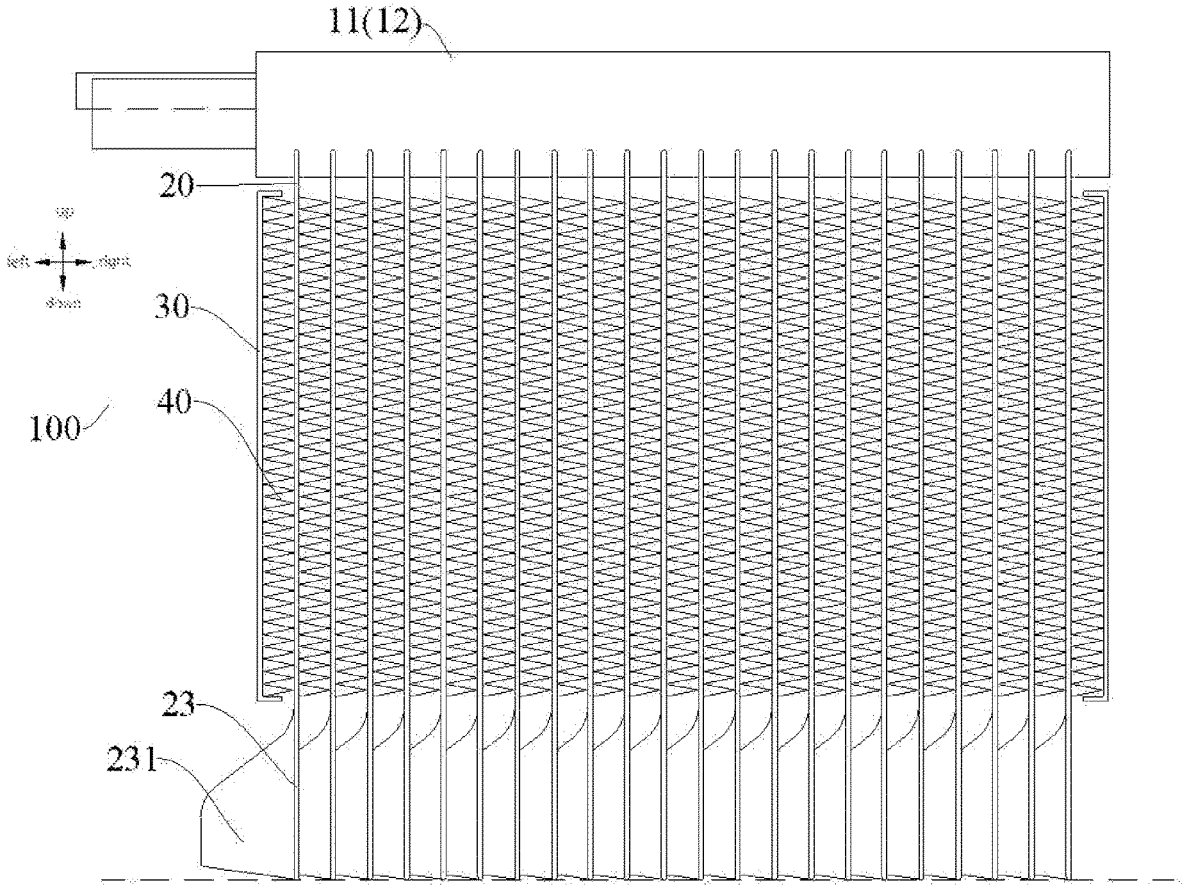
FIG. 1 is a front view of a heat exchanger to be processed according to an embodiment of the present disclosure.

REFERENCE NUMERALS heat exchanger 100;
collecting tube 10; first tube 11; second tube 12;
heat exchange tube 20; first section 21; second section 22; bent section 23; twisted section 231;
side plate 30;
fin 40;
pushing member 50; circular arc surface 51; plane surface 52; circular member 501; shaft 502; support member 503; protrusion 504.

DETAILED DESCRIPTION

Hereinafter, embodiments of the present disclosure will be described in detail, examples of embodiments are illustrated in the accompanying drawings. Embodiments described below with reference to the accompanying drawings are illustrative and are intended to explain the present disclosure, and should not be construed as limiting the present disclosure.

In related art, after the heat exchangers are put into use, dust and moisture in the air will enter the overlapping contact parts of the heat exchange tubes, which will accelerate the corrosion of these heat exchange tubes and affect the reliability of the heat exchange tubes. In the related art, it is necessary to increase the distance between adjacent heat exchange tubes in order to make the bent sections of the heat exchange tubes not contact. In a limited heat exchange area, increasing the distance between adjacent heat exchange tubes will reduce the number of heat exchange tubes and affect the heat exchange performance.

As shown in FIGS. 1-14, a method for processing a heat exchanger according to embodiments of the present disclosure includes the following steps.

Figure 2:
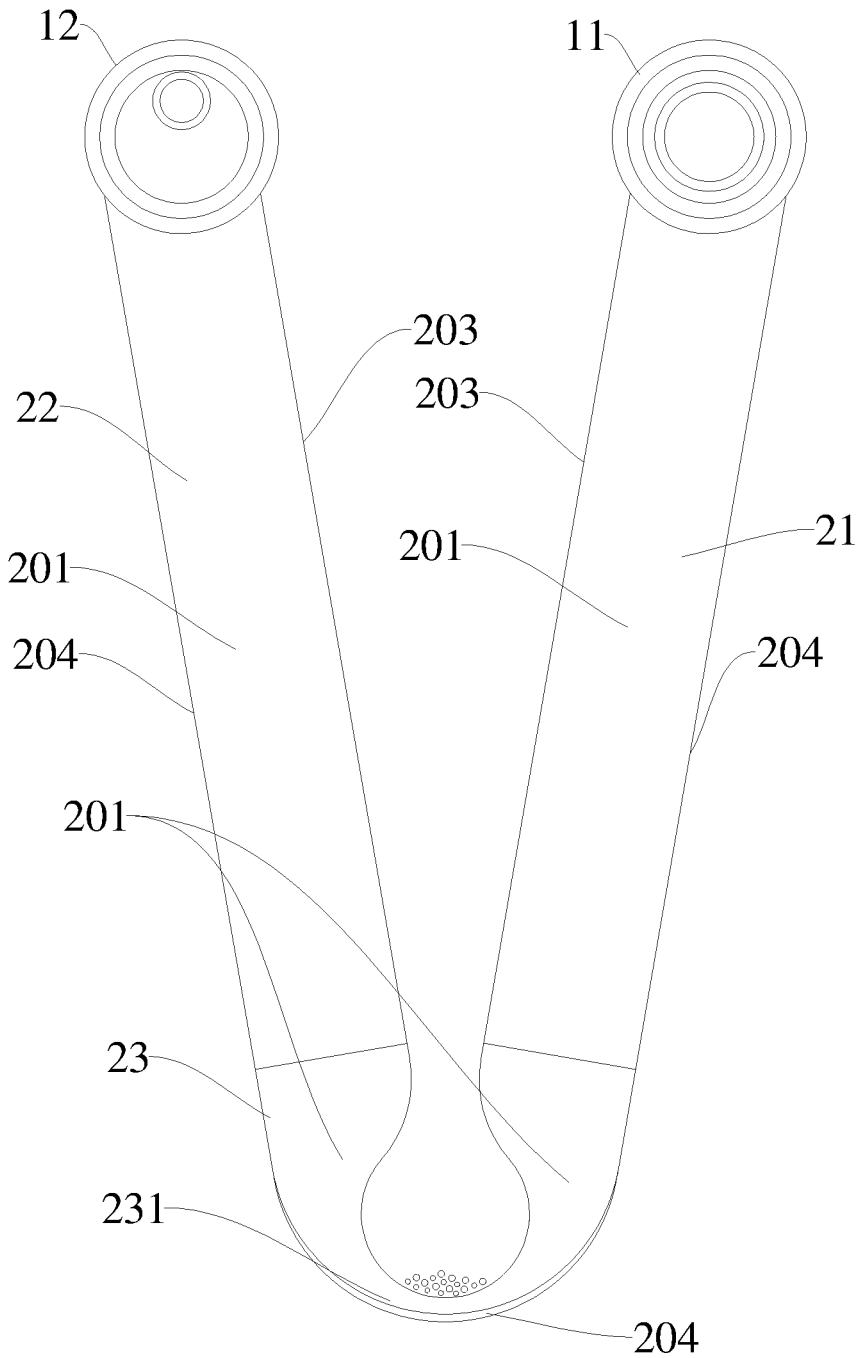
FIG. 2 is a schematic view of a heat exchange tube in FIG. 1.

A heat exchanger 100 is prepared. The heat exchanger 100 includes a first tube 11, a second tube 12 and a heat exchange tube 20. The heat exchange tube 20 is a microchannel flat tube, and the heat exchange tube 20 communicates the first tube 11 with the second tube 12. The heat exchange tube 20 includes a first section 21, a second section 22 and a bent section 23, an end of the bent section 23 is connected with the first section 21 and the other end of the bent section 23 is connected with the second section 22. There is a plurality of heat exchange tubes 20, and the plurality of heat exchange tubes 20 is arranged at intervals along a length direction of the first tube 11. The bent section 23 of one heat exchange tube 20 is in contact with at least part of the bent section 23 of another heat exchange tube 20 11 adjacent to the one heat exchange tube 20 in the length direction (a left-right direction in FIG. 1) of the first tube. As shown in FIGS. 1 and 2, the first sections 21 of the plurality of heat exchange tubes 20 are arranged at intervals along the length direction of the first tube 11, and the second sections 22 of the plurality of heat exchange tubes 20 are arranged at intervals along the length direction of the first tube 11. The bent section 23 of the heat exchange tube 20 includes a twisted section 231, and the twisted section 231 is formed by twisting at least part of the bent section 23 of the heat exchange tube 20 relative to the first section 21 of the heat exchange tube 20. Specifically, at least part of the bent section 23 of the heat exchange tube 20 is twisted to the left relative to the first section 21, thereby forming a twisted section 231. The twisted section 231 of the bent section 23 of one heat exchange tube 20 is in contact with at least part of the twisted section 231 of the bent section 23 of another adjacent heat exchange tube 20. Specifically, the first tube 11 and the second tube 12 are the collecting tubes 10 of the heat exchanger 100. The heat exchanger 100 also includes side plates 30 and fins 40, the side plates 30 are arranged on left and right sides of the heat exchanger 100, and the fins 40 are connected with the heat exchange tubes 20. The arrangement mode of the fins 40 is selected according to types and use scenarios of the heat exchanger 100.

A pushing member 50 is placed, so that at least part of the pushing member 50 is in contact with at least part of the bent section 23 of at least one heat exchange tube 20. Specifically, as shown in FIGS. 5, 7, 9 and 11, the pushing member 50 is placed below the heat exchanger 100, a top of the pushing member 50 is in contact with a bottom of the bent section 23 of the heat exchange tube 20, and a position of a top end of the pushing member 50 is higher than a position of a bottom end of the bent section 23 of the heat exchange tube 20. That is, the top of the pushing member 50 contacts at least a right side of the bottom of the bent section 23. Therefore, when at least part of the pushing member 50 and the heat exchange tube 20 move relatively in the length direction of the first tube 11, the bent section 23 can rotate by a predetermined angle or move by a predetermined distance relative to the first section 21 connected with the bent section.

The pushing member 50 is moved to drive the bent section 23 to rotate by a predetermined angle or move by a predetermined distance relative to the first section 21 connected with the bent section, and/or the bent section 23 of the heat exchange tube 20 is moved, that is, a position of the bent section 23 of the heat exchanger 100 in the length direction of the first tube 11 is changed, so that the bent section 23 rotates by a predetermined angle or moves by a predetermined distance relative to the first section 21 connected with the bent section. Generally, the pushing member 50 and the bent section 23 of the heat exchange tube 20 move relatively in the length direction of the first tube 11.

Thus, the bent section 23 of one heat exchange tube 20 is not in contact with the bent section 23 of the heat exchange tube 20 adjacent to the one heat exchange tube in the length direction of the first tube 11. That is, there is a gap between the bent section 23 of one heat exchange tube 20 and the bent section 23 of one or two heat exchange tubes 20 adjacent to the one heat exchange tube in the length direction of the first tube 11.

It can be understood that the movement of the pushing member 50 includes translation and rotation. That is, the pushing member 50 can rotate to drive the bent section 23 to rotate by a predetermined angle or move by a predetermined distance relative to the first section 21 connected with the bent section, and the pushing member 50 can also translate to drive the bent section 23 to rotate by a predetermined angle or move by a predetermined distance relative to the first section 21 connected with the bent section.

Figure 3:
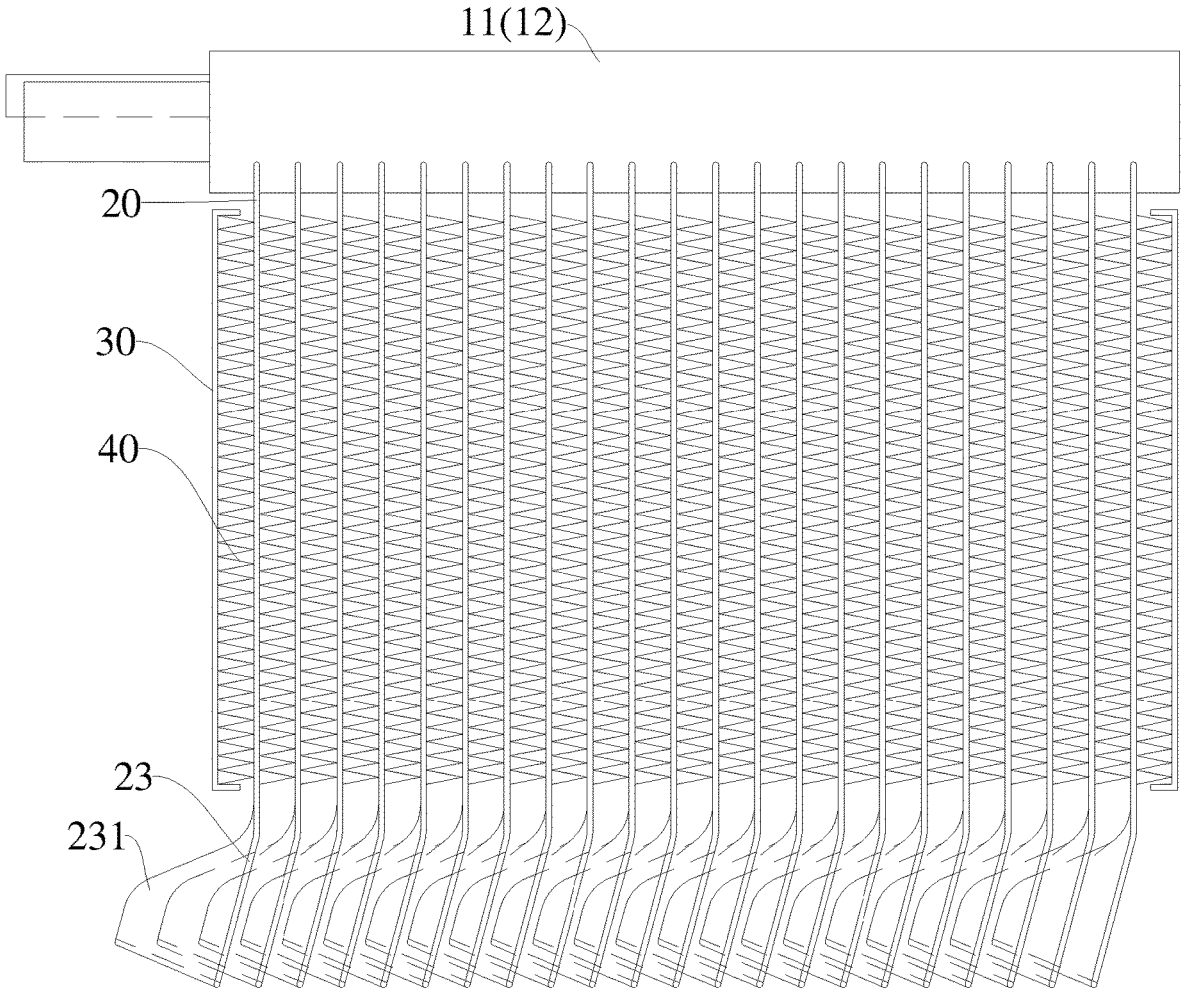
FIG. 3 is a schematic view of a processed heat exchanger according to an embodiment of the present disclosure.
Figure 4:
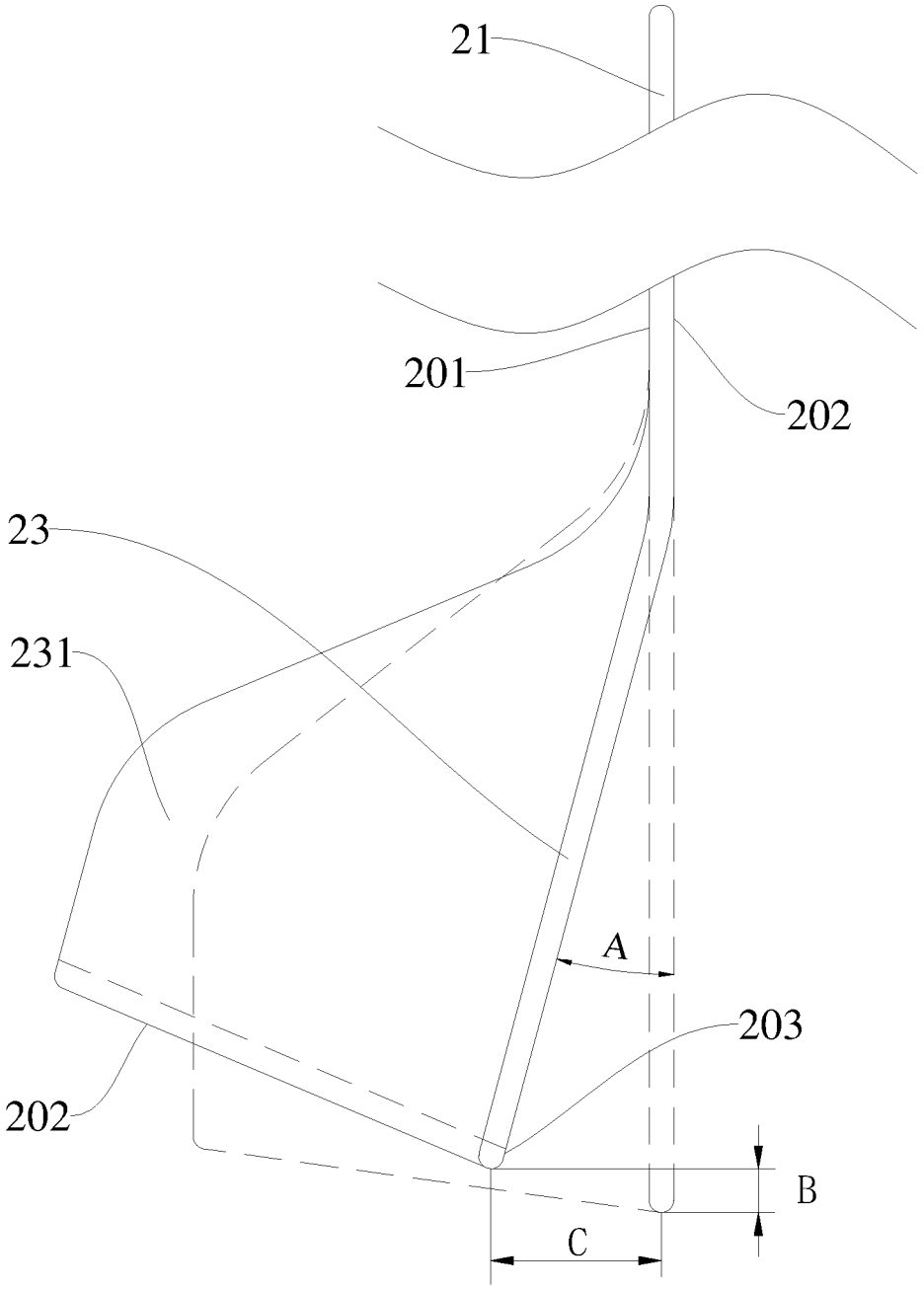
FIG. 4 is a schematic view of a heat exchange tube in FIG. 3.

As shown in FIGS. 3 and 4, the bent section 23 rotates by an angle A relative to the first section 21, and at the same time, the bottom of the bent section 23 moves by a distance B in an up-down direction and a distance C in the left-right direction.

The pushing member 50 moves and translates in the length direction of the first tube 11, that is, a position of the pushing member 50 in the length direction of the first tube 11 (as the left-right direction in FIG. 1) is changed, and the bent sections 23 of the plurality of heat exchange tubes 20 of the heat exchanger 100 sequentially rotate by a predetermined angle or move by a predetermined distance relative to the first sections 21 respectively connected with the bent sections.

According to the method for processing a heat exchanger of embodiment of the present disclosure, the pushing member 50 moves relative to the bent section 23 of the heat exchange tube 20, so that the bent section 23 of one heat exchange tube 20 is not in contact with the bent section 23 of another adjacent heat exchange tube 20, the accumulation of dust and moisture in the air on the twisted section 231 of the bent section 23 can be reduced, and the corrosion of the heat exchange tube 20 can be slowed down, facilitating improvement in the reliability of the heat exchanger. In addition, the distance between adjacent heat exchange tubes 20 does not increase, so it is beneficial to improving the heat exchange performance of the heat exchanger 100.

Therefore, the method for processing a heat exchanger of embodiments of the present disclosure is beneficial to improving the reliability and heat exchange performance of the heat exchanger 100.

In some embodiments, as shown in FIGS. 3 and 4, the heat exchange tube 20 includes a first side surface and a second side surface arranged in a first direction, and the heat exchange tube 20 includes a third side surface and a fourth side surface arranged in a second direction. It should be noted herein that in the first section 21 and the second section 22 of the heat exchange tube 20, the first direction is a thickness direction of the first section 21 (as the left-right direction in FIG. 1), the second direction is a width direction of the first section 21, and the first, second, third and fourth side surfaces are plane surfaces. In the bent section 23 and the twisted section 231 of the heat exchange tube 20, the first direction and the second direction are not fixed, but change with twisting of the bent section 23, and the first, second, third and fourth side surfaces are curved surfaces. Specifically, the projections of the first side surface, the second side surface, the third side surface and the fourth side surface of the heat exchange tube 20 on a cross section of the heat exchange tube 20 forms a peripheral outline of the heat exchange tube 20 on the cross section. For example, as illustrated in FIG. 4, the first side surface of the twisted section 231 is substantially faces upwards, the second side surface of the twisted section 231 is substantially faces downwards, the third side surface of the twisted section 231 is substantially faces rightwards, and the fourth side surface of the twisted section 231 is substantially faces leftwards.

As shown in FIGS. 5-12, during the movement, the pushing member 50 contacts a part of the third side of at least one bent section 23, to drive the bent section 23 to rotate by a predetermined angle or move by a predetermined distance relative to the first section 21 connected with the bent section.

As shown in FIGS. 5-10 and. 15-17, the pushing member 50 has a circular arc surface 51, and the pushing member 50 translates from right to left. During the movement of the pushing member 50, the circular arc surface 51 of the pushing member 50 contacts the third side surface of the bent section 23, thus driving the bent section 23 to rotate by a predetermined angle or move by a predetermined distance relative to the first section 21 connected with the bent section.

A position of the top end of the pushing member 50 is higher than a position of the bottom end of the bent section 23 of the heat exchange tube 20, and a distance between the top end of the pushing member 50 and the bottom end of the bent section 23 of the heat exchange tube 20 is D. It can be understood that D is greater than or equal to B, increasing the number of times the pushing member 50 translates from right to left can increase the value of B, and increasing the value of D can also increase the value of B.

Figure 7:
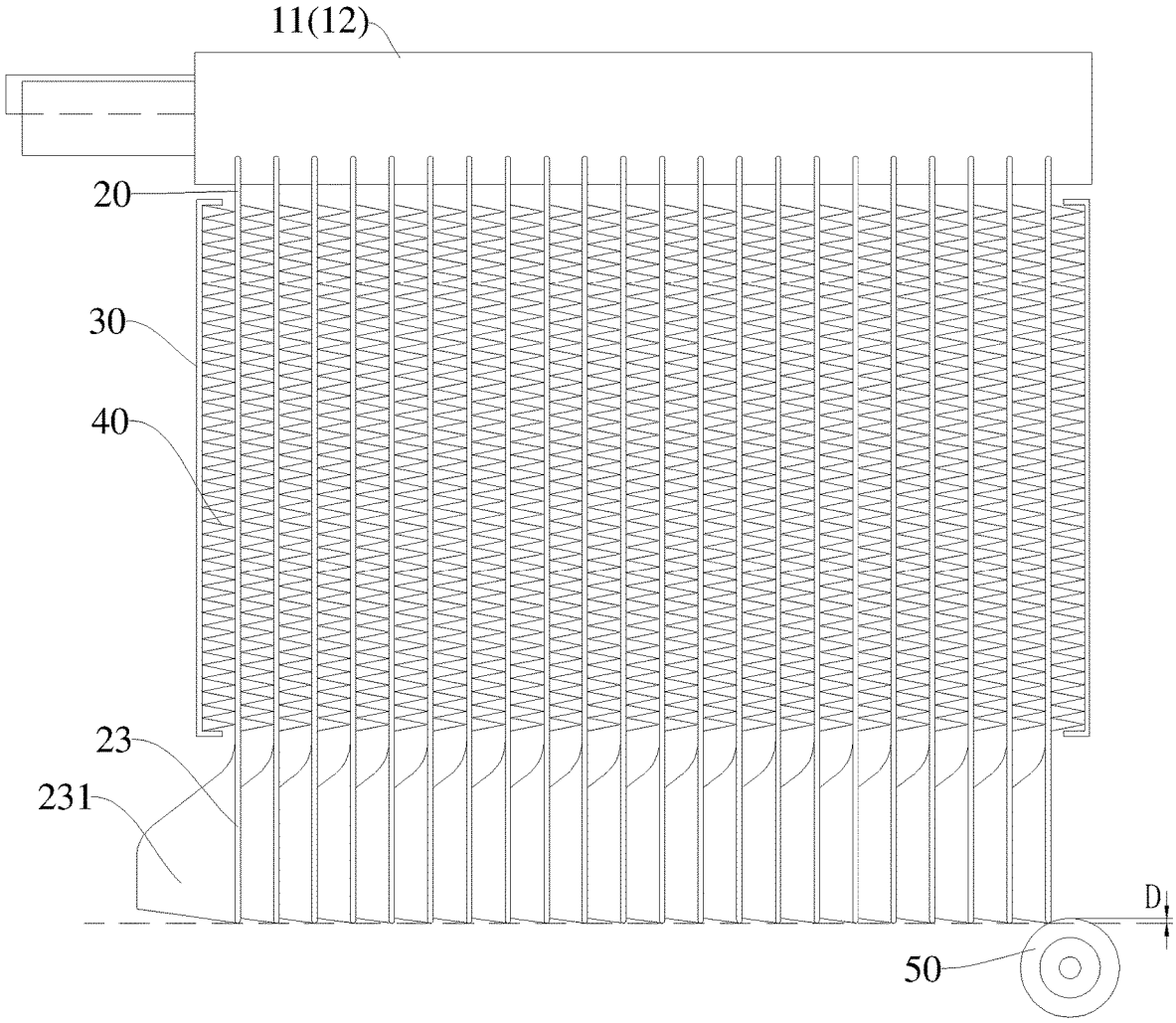
FIG. 7 is a first schematic view of a heat exchanger in a method for processing a heat exchanger according to a second embodiment of the present disclosure.
Figure 8:
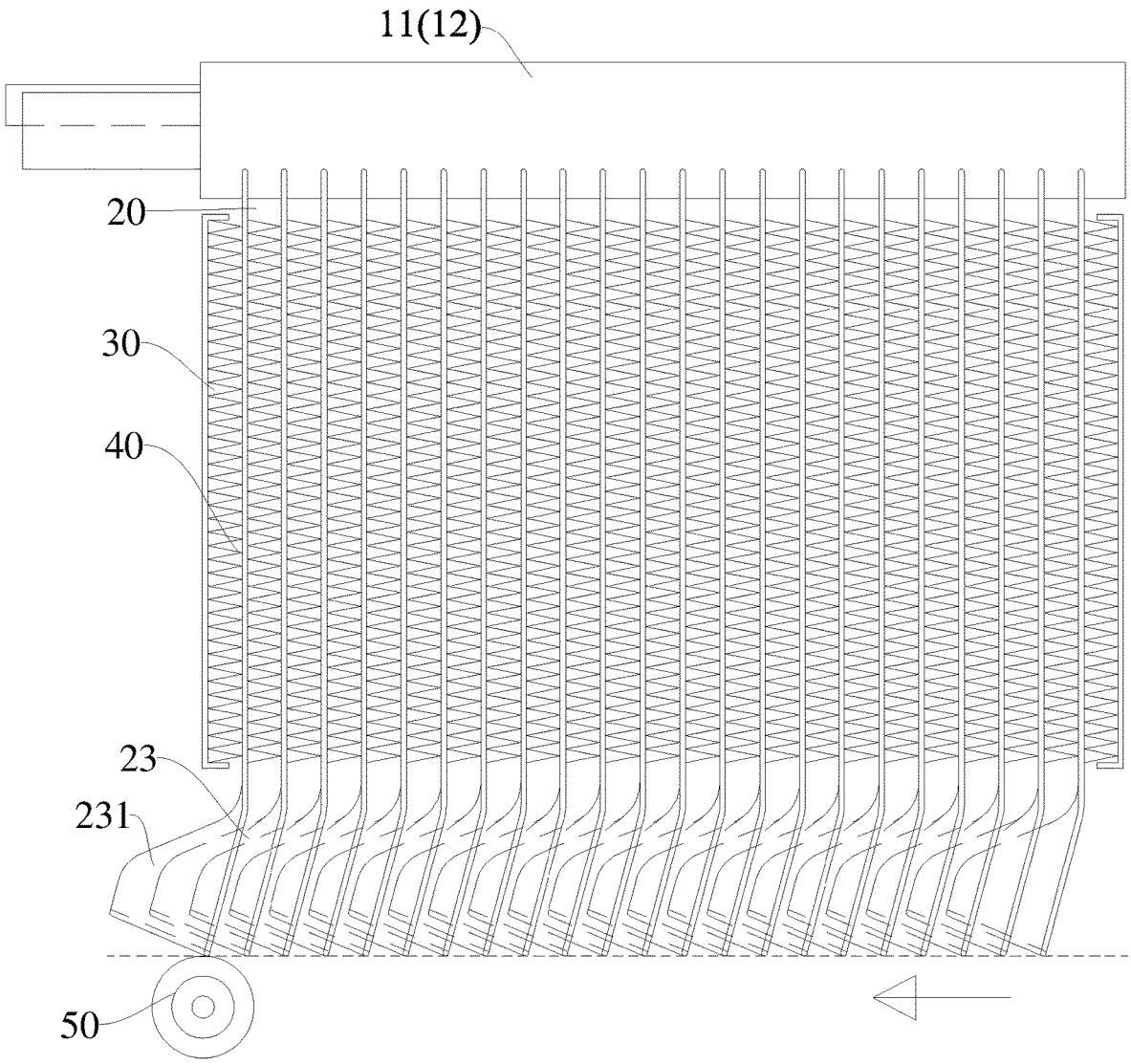
FIG. 8 is a second schematic view of a heat exchanger in a method for processing a heat exchanger according to a second embodiment of the present disclosure.
Figure 16:
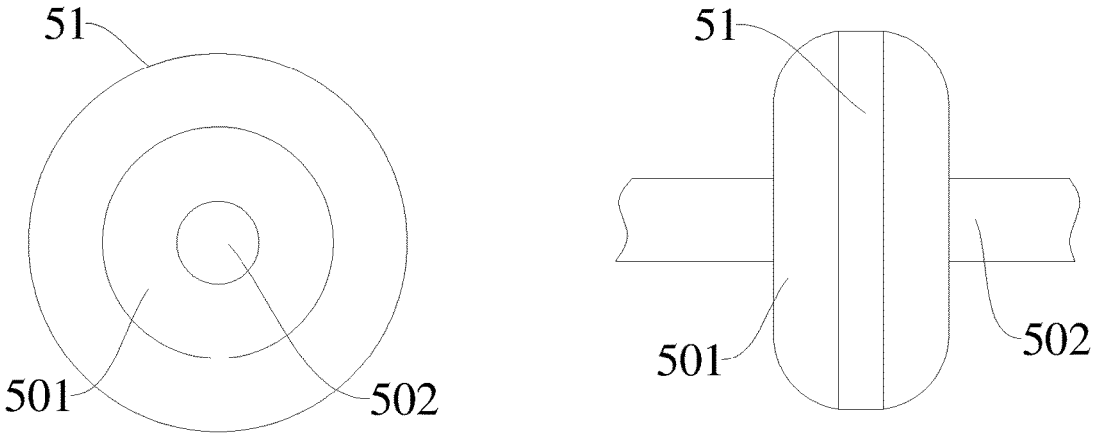
FIG. 16 is a schematic view of a pushing device for processing a heat exchanger according to another embodiment of the present disclosure.

In some embodiments, as shown in FIGS. 7, 8 and 16, the pushing member 50 includes a rotating part and a shaft 502. The rotating part at least partially includes a circumferential surface, and the circumferential surface of the rotating part is in contact with a part of the bent section 23 of at least one heat exchange tube 20.

According to the method for processing a heat exchanger of embodiments of the present disclosure, after the part of the circumferential surface of the rotating part contacting the bent section 23 is worn, the rotating part can rotate around an axis of the shaft 502 by a certain angle without replacing the pushing member 50, so that the heat exchanger 100 can be processed continuously, the service life of the pushing member 50 can be prolonged, and the processing efficiency can be improved.

Figure 9:
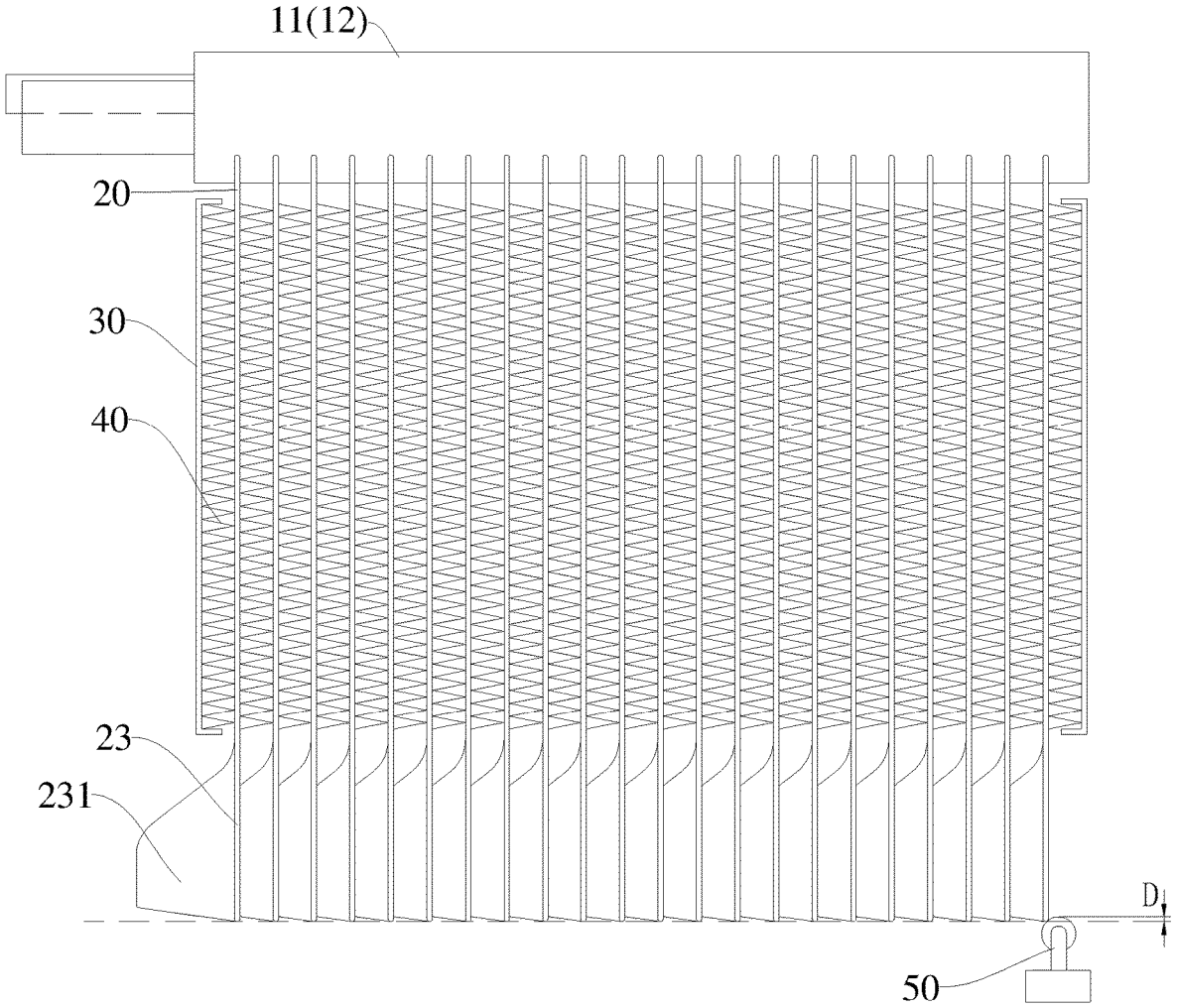
FIG. 9 is a first schematic view of a heat exchanger in a method for processing a heat exchanger according to a third embodiment of the present disclosure.
Figure 10:
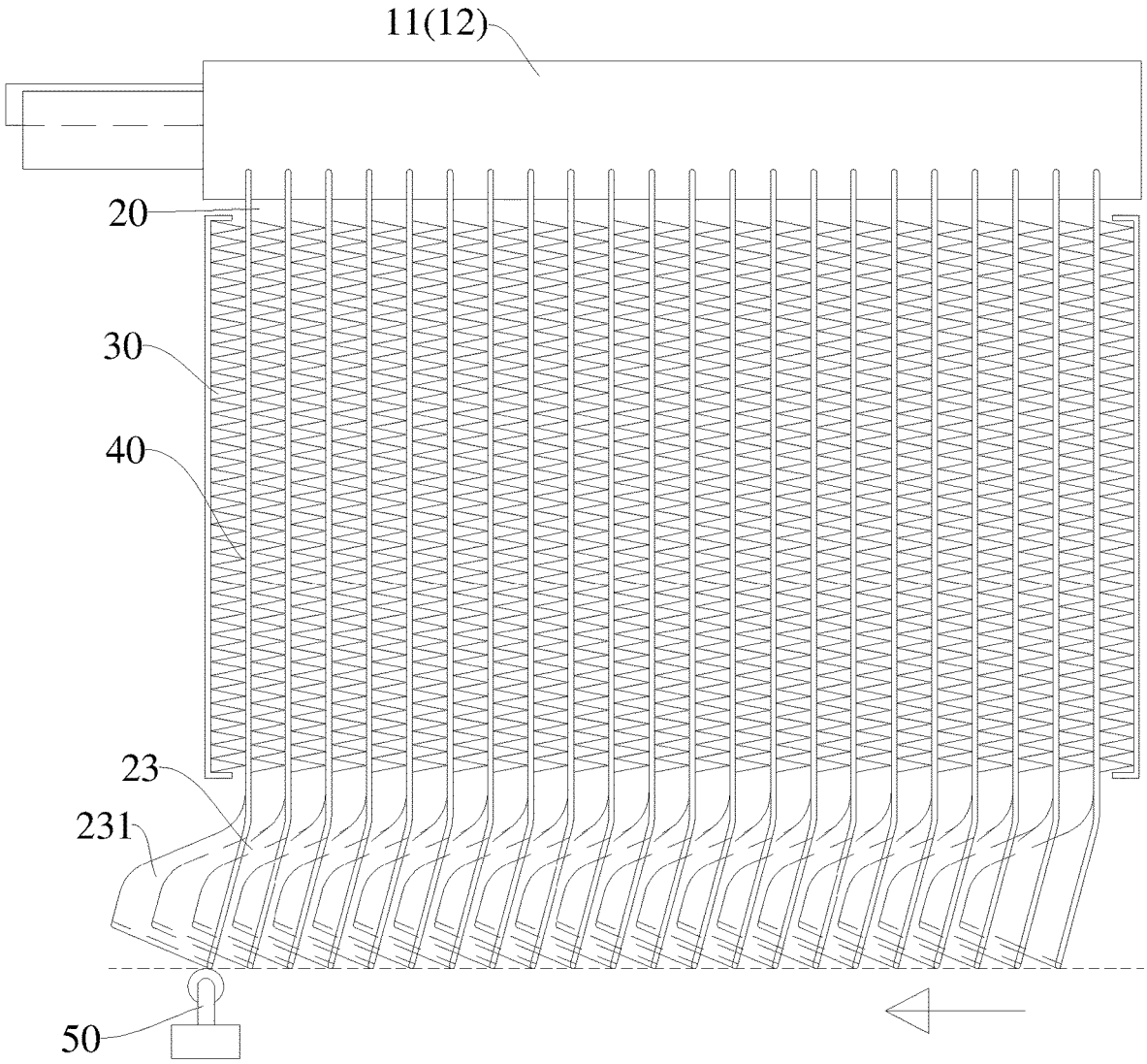
FIG. 10 is a second schematic view of a heat exchanger in a method for processing a heat exchanger according to a third embodiment of the present disclosure.
Figure 17:
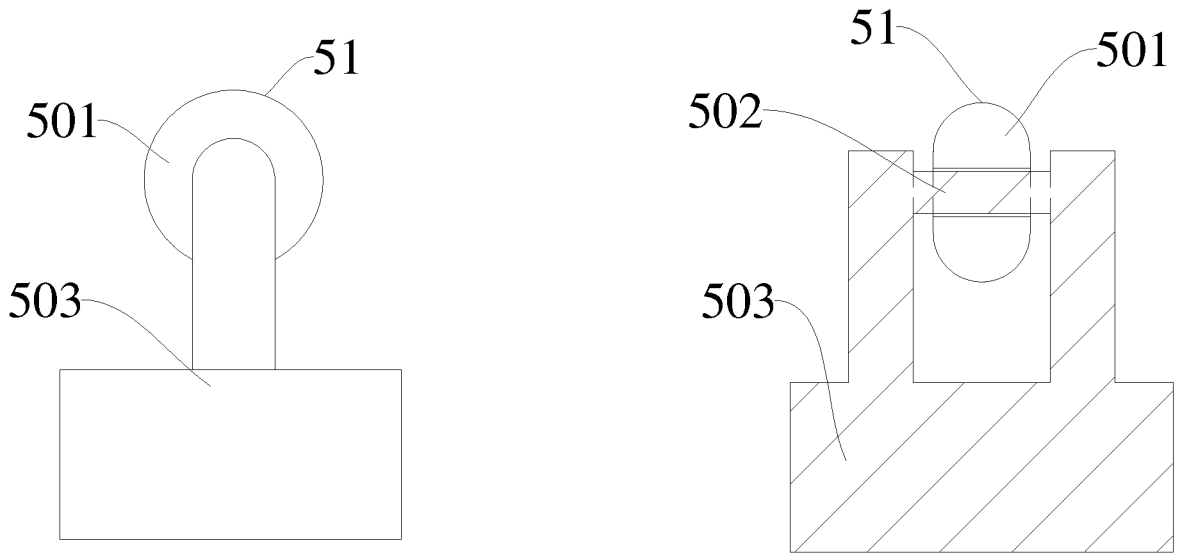
FIG. 17 is a schematic view of a pushing device for processing a heat exchanger according to yet another embodiment of the present disclosure.

Further, as shown in FIGS. 9, 10 and 17, during the movement of the pushing member 50, the rotating part rotates around an axis of the shaft 502, and a rotation direction of the rotating part is opposite to a rotation direction of the bent section 23 relative to the first section 21 connected with the bent section. It can be understood that when the rotating part rotates counterclockwise, the pushing member 50 moves from right to left, and the rotation direction of the rotating part is the same as the moving direction of the whole pushing member 50.

According to the method for processing a heat exchanger of embodiments of the present disclosure, while the pushing member 50 moves in the length direction of the first tube 11, an external force drives the rotating part to rotate around the axis of the shaft 502, and the rotation direction of the rotating part is the same as the moving direction of the pushing member 50, so that the processing efficiency can be improved. In addition, a horizontal pushing force of the pushing member 50 on the heat exchange tube 20 is reduced during movement, and the deformation of the heat exchanger 100 can be improved.

Figure 11:
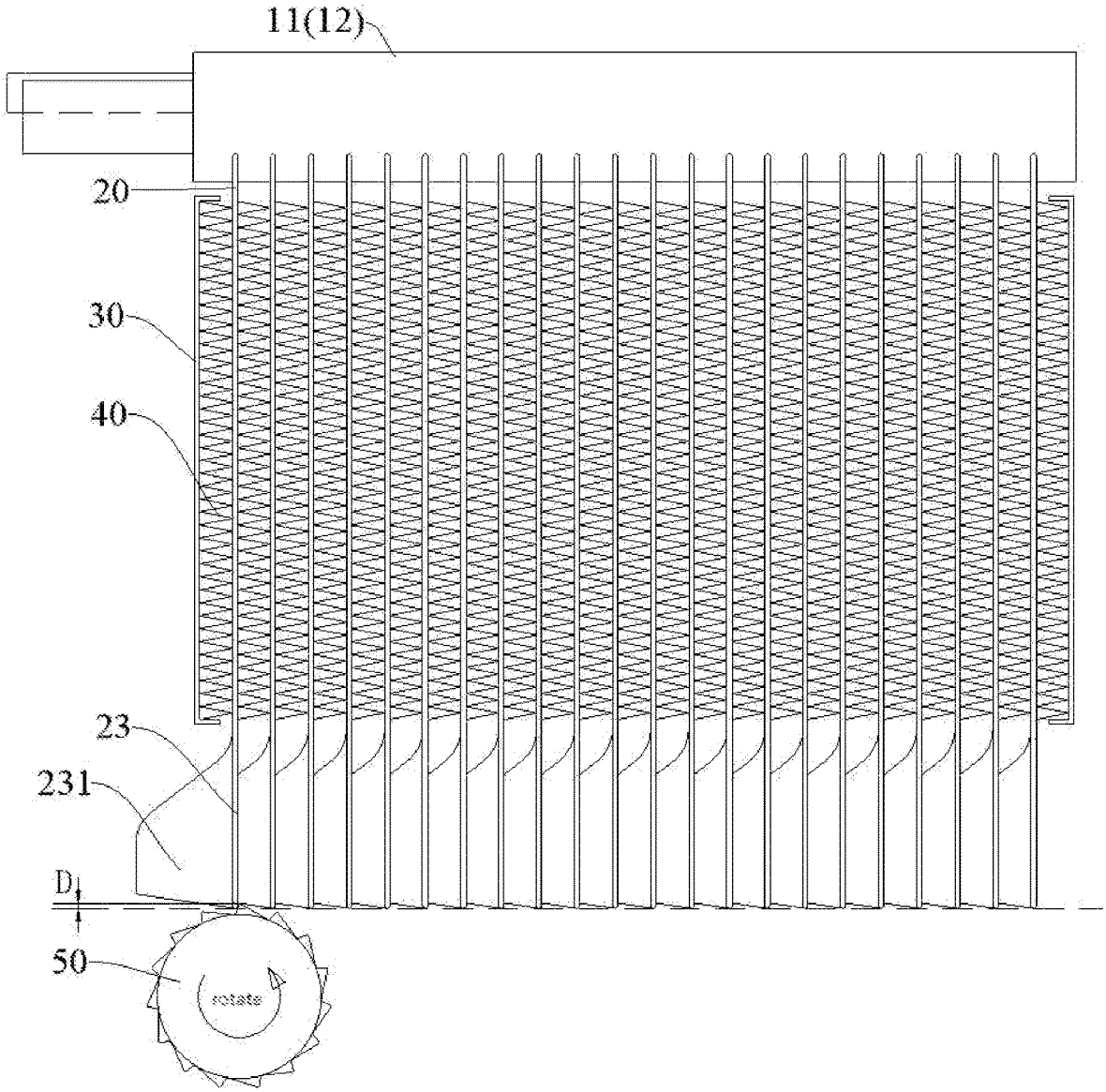
FIG. 11 is one of the schematic views of a heat exchanger in a method for processing a heat exchanger according to a fourth embodiment of the present disclosure.
Figure 12:
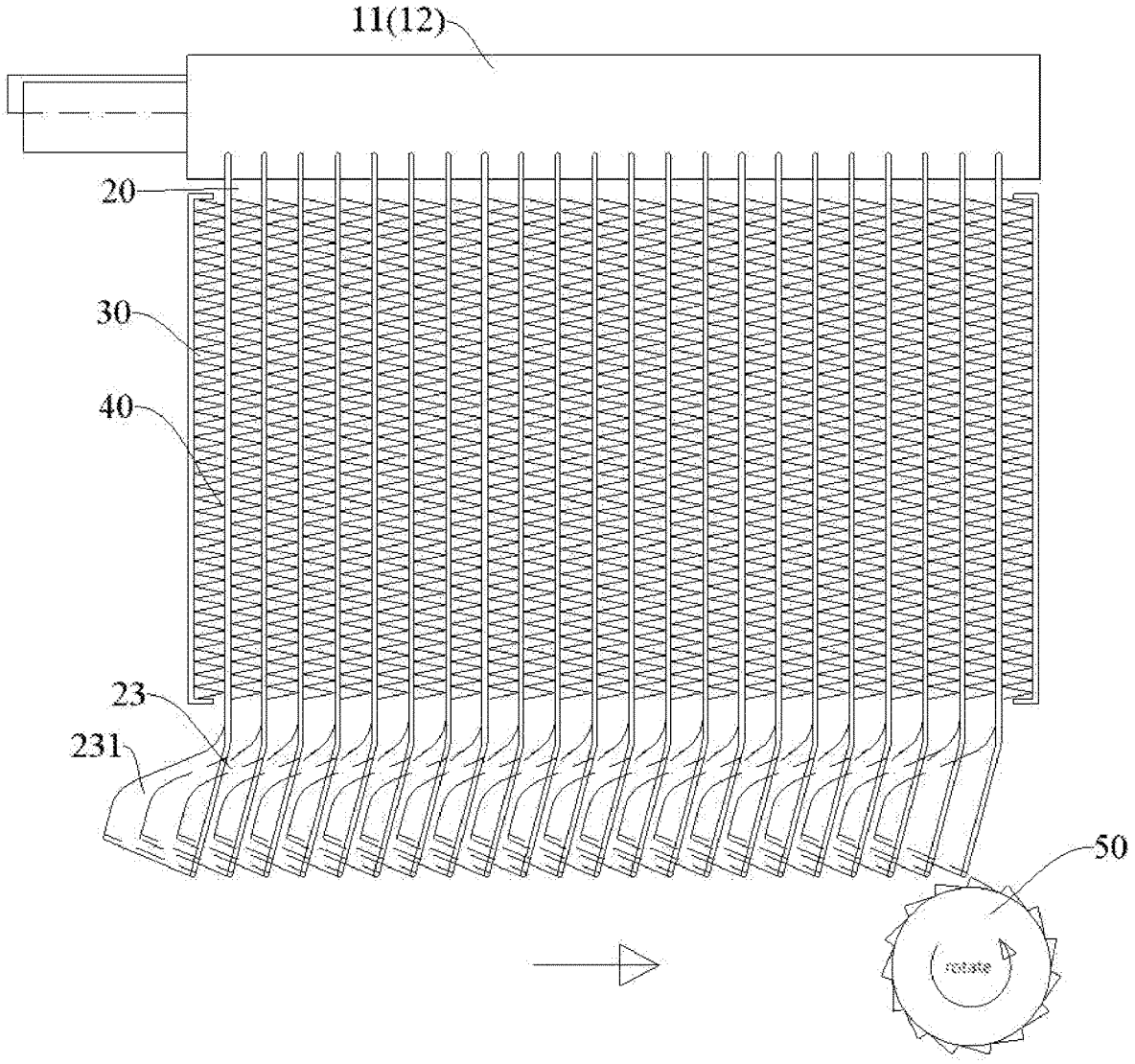
FIG. 12 is a schematic view of a heat exchanger in a method for processing a heat exchanger according to a fourth embodiment of the present disclosure.
Figure 18:
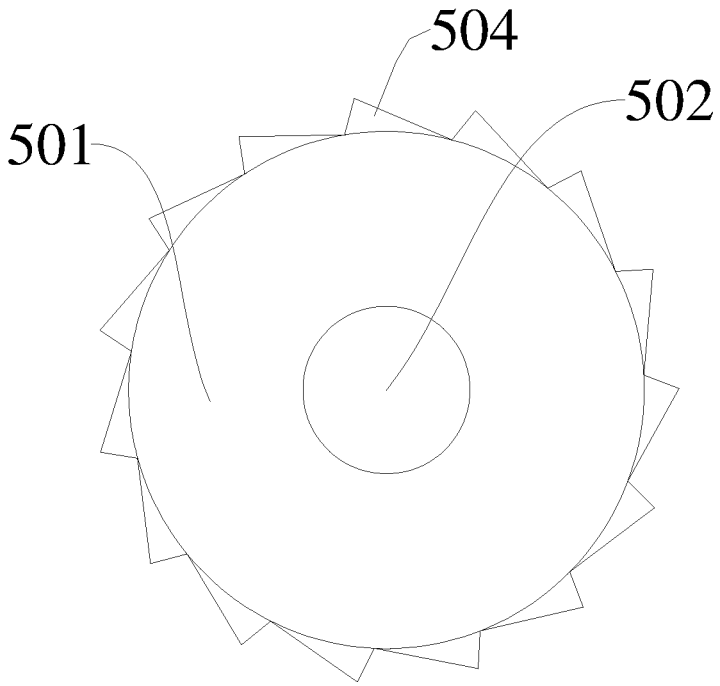
FIG. 18 is a schematic view of a pushing device for processing a heat exchanger according to still another embodiment of the present disclosure.
Figure 19:
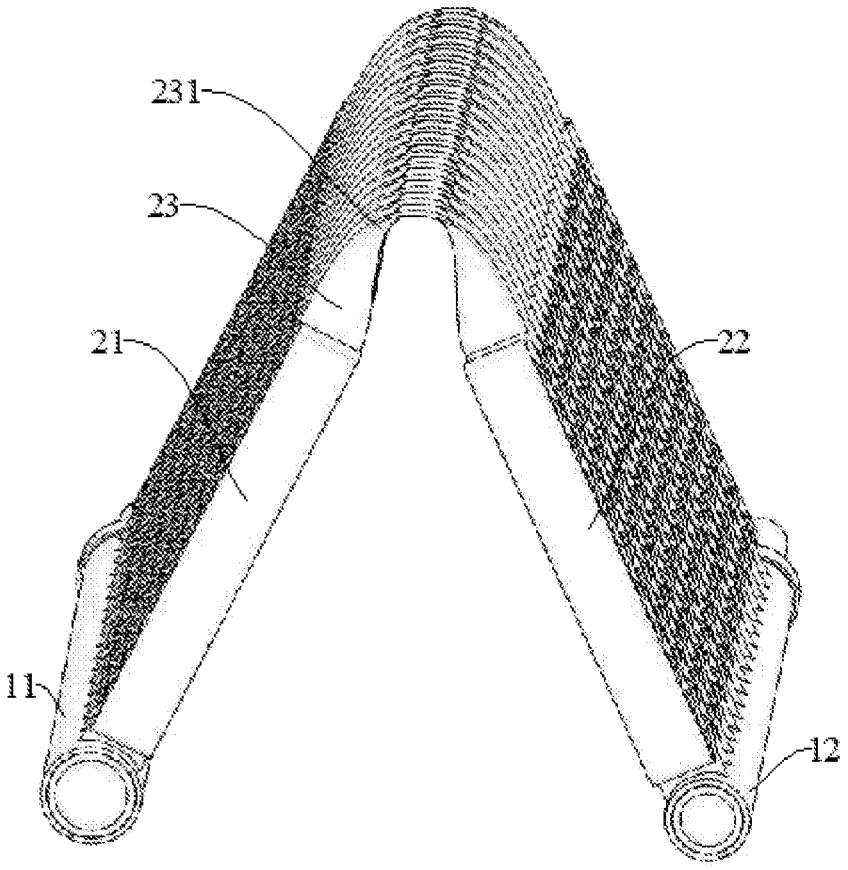
FIG. 19 is a schematic view of a processed heat exchanger.
Figure 20:
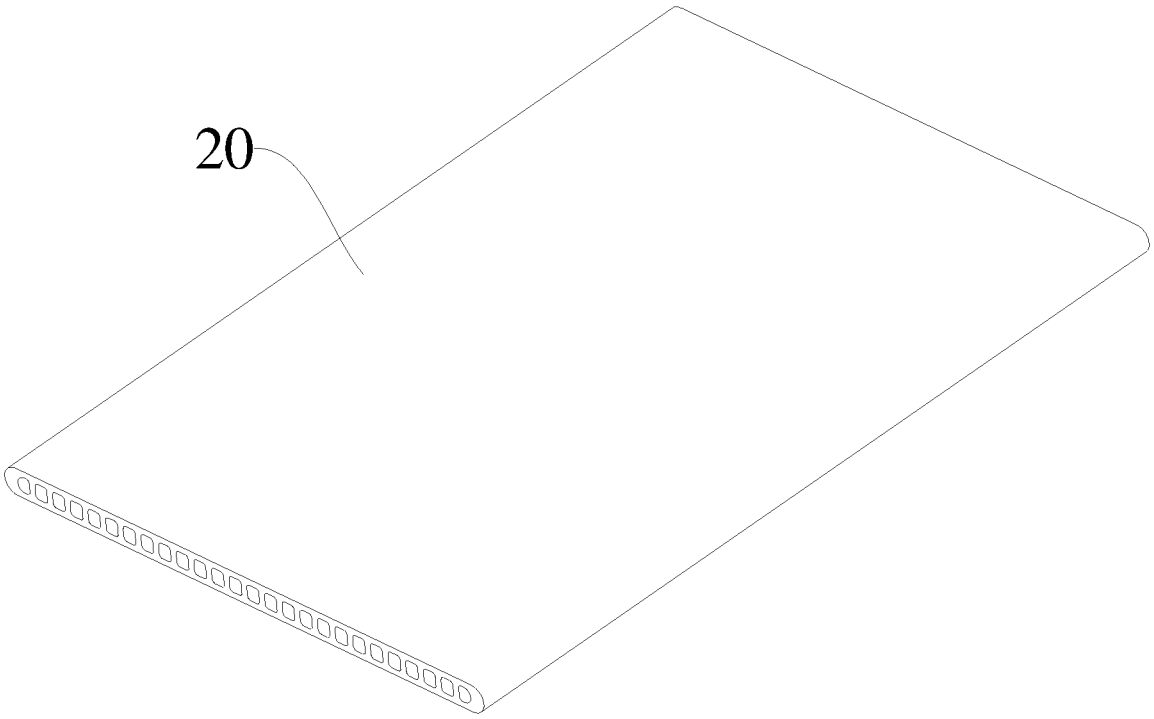
FIG. 20 is a schematic view of a three-dimensional structure of a heat exchange tube.

As shown in FIGS. 11, 12 and 18, the pushing member 50 includes a circular member 501 and a protrusion 504. The circular member 501 can rotate around its axis, and the protrusion 504 is arranged on an outer peripheral surface of the circular member 501. There is a plurality of protrusions 504, and the plurality of protrusions 504 are arranged at intervals along the circumferential direction of the circular member 501. The circular member 501 rotates counterclockwise, and the pushing member 50 translates from left to right, that is, the rotation direction of the circular member 501 is opposite to the moving direction of the pushing member 50. During the movement of the pushing member 50, the protrusion 504 of the pushing member 50 contacts the third side surface of the bent section 23.

The position of the top end of the pushing member 50 is higher than the position of the bottom end of the bent section 23 of the heat exchange tube 20, and the distance between the top end of the pushing member 50 and the bottom end of the bent section 23 of the heat exchange tube 20 is D. It can be understood that D is greater than or equal to B, increasing the number of times the pushing member 50 translates from left to right can increase the value of B, and increasing the value of D can also increase the value of B.

According to the method for processing a heat exchanger of embodiments of the present disclosure, the protrusion 504 of the pushing member 50 is in contact with the third side surface of the bent section 23, and the rotation of the circular member 501 makes the protrusion 504 drive the bent section 23 to rotate by a predetermined angle or move by a predetermined distance relative to the first section 21 connected with the bent section. The circular member 501 rotates counterclockwise, and the pushing member 50 translates from left to right. During a translation of the pushing member 50, and the rotation angle or moving distance of the bent section 23 of each heat exchange tube 20 is equal, which is beneficial to improving the aesthetic appearance of the heat exchanger 100. Moreover, the heat exchange tubes 20 are not pushed in the horizontal direction, which can improve the deformation of the heat exchanger 100, that is, the deformation amount of the heat exchanger 100 can be reduced.

Figure 13:
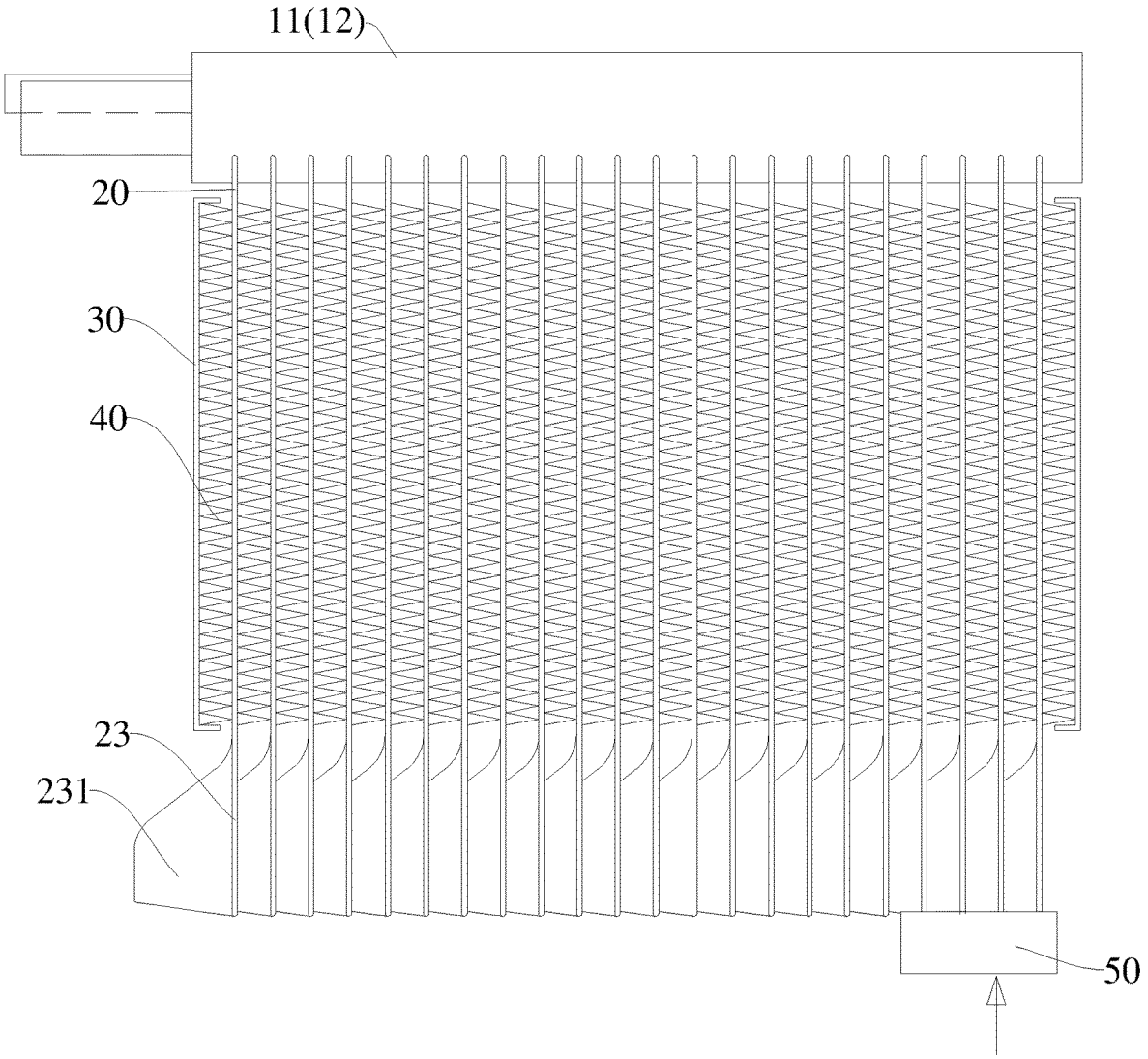
FIG. 13 is a schematic view of a heat exchanger in a method for processing a heat exchanger according to a fifth embodiment of the present disclosure.
Figure 14:
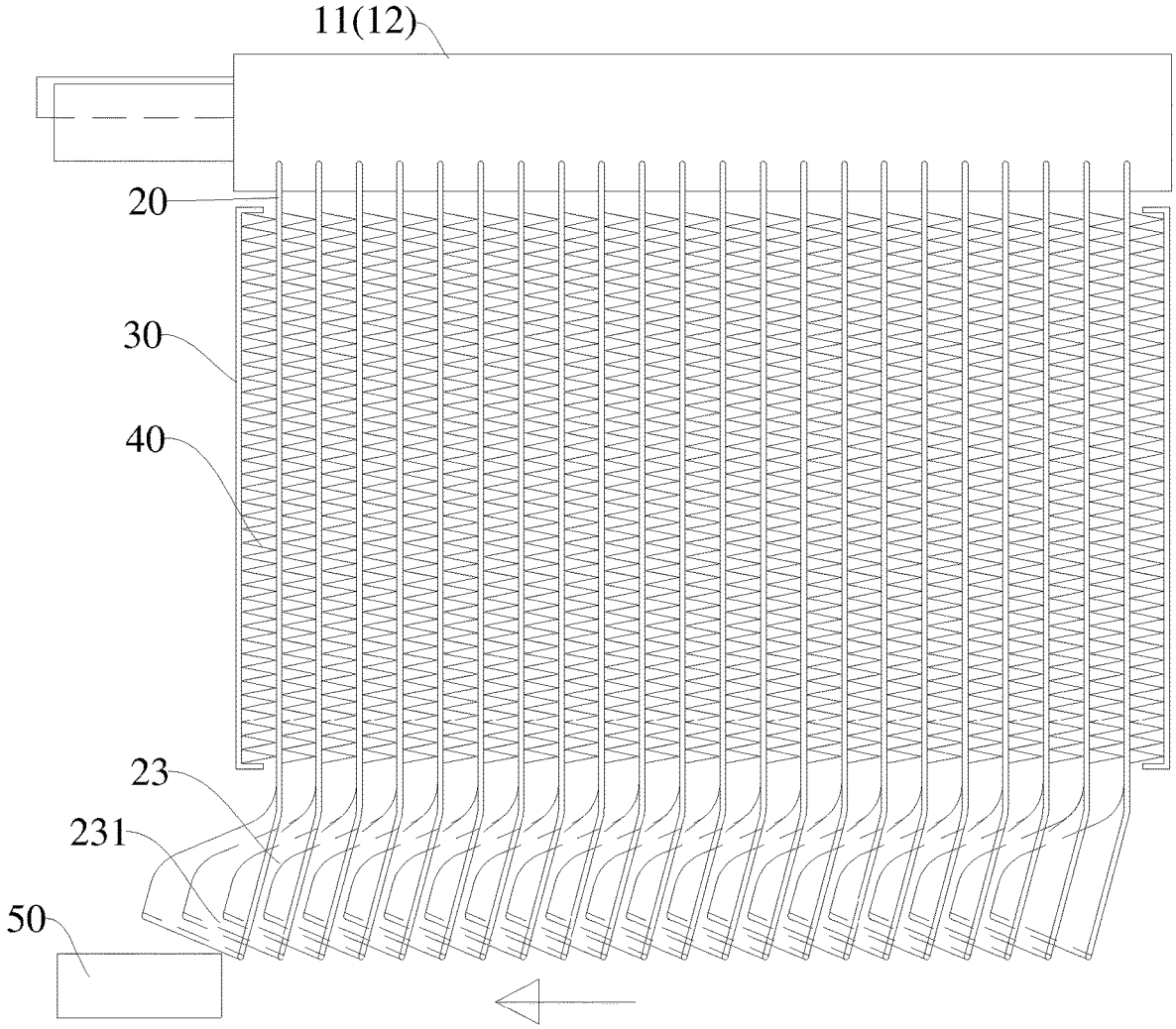
FIG. 14 is a schematic view of a heat exchanger in a method for processing a heat exchanger according to a fifth embodiment of the present disclosure.

In some embodiments, as shown in FIGS. 13 and 14, the pushing member 50 is also in contact with a part of the second side surface of at least one bent section 23 during the movement, to drive the bent section 23 to rotate by a predetermined angle or move by a predetermined distance relative to the first section 21 connected with the bent section.

Specifically, the pushing member 50 is made of flexible material, and contacts the bent section 23 from bottom to top, thus the pushing ember 50 is compressed, so that an upper surface of the pushing member 50 is deformed and contacts the second side surface of the bent section 23. The pushing member 50 moves from right to left, and under the action of friction, the bent section 23 is driven to rotate by a predetermined angle or move by a predetermined distance relative to the first section 21 connected with the bent section.

Further, during movement, the pushing member 50 contacts with a plurality of bent sections 23 at the same time, to drive the plurality of bent sections 23 to rotate by a predetermined angle or move by a predetermined distance relative to the first sections 21 respectively connected with the plurality of bent sections.

According to the method for processing the heat exchanger in embodiments of the present disclosure, when the pushing member 50 moves, it can drive the bent section 23 to rotate by a predetermined angle or move by a predetermined distance relative to the first section 21 connected with the bent section 23, without positioning, thus simplifying the processing technology and improving the processing efficiency.

Hereinafter, a pushing device for processing a heat exchanger according to embodiments of the present disclosure will be described with reference to the drawings.

As shown in FIGS. 15-20, the pushing device for processing a heat exchanger according to embodiments of the present disclosure is configured to push the heat exchange tube 20 to rotate or move. The pushing device includes a pushing member 50, and the pushing member 50 includes an outer surface, and surface hardness of at least part of the outer surface is less than or equal to surface hardness of the heat exchange tube 20.

Further, the pushing member includes a circular arc surface 51 or an inclined surface, and the surface hardness of at least part of the circular arc surface 51 or the inclined surface is less than or equal to the surface hardness of the heat exchange tube 20.

The circular arc surface 51 or the inclined surface of the pushing member can contact the heat exchange tube 20, so that the bent section 23 of the heat exchange tube 20 can be pushed to rotate by a predetermined angle or move by a predetermined distance relative to the first section 21 of the heat exchange tube 20.

As shown in FIGS. 5-12, a position of the top end of the pushing member 50 is higher than a position of the bottom end of the bent section 23 of the heat exchange tube 20, and the distance between the top end of the pushing member 50 and the bottom end of the bent section 23 of the heat exchange tube 20 is D. It can be understood that D is greater than or equal to B, increasing the number of times the pushing member 50 translates from right to left can increase the value of B, and increasing the value of D can also increase the value of B.

According to the pushing device for processing a heat exchanger in embodiments of the present disclosure, the pushing member moves or the heat exchanger moves, the bent section 23 of the heat exchange tube 20 of the heat exchanger 100 can rotate by a predetermined angle or move by a predetermined distance relative to the first section 21 connected with the bent section, and then the bent section 23 of one heat exchange tube 20 is not in contact with the bent section 23 of another adjacent heat exchange tube 20, so that the accumulation of dust and moisture in the air on the twisted section 231 of the bent section 23 of the heat exchange tube 20 can be reduced, thereby slowing down the corrosion of the heat exchange tube 20 and improving the reliability of the heat exchange tube.

In addition, the surface hardness of the outer surface of the pushing member 50 is less than or equal to the surface hardness of the heat exchange tube 20, so that the heat exchange tube 20 can be prevented from being squeezed and deformed or from scratching the surface, which is beneficial to improving the reliability of the heat exchange tube.

Therefore, the pushing device for processing a heat exchanger according to embodiments of the present disclosure can reduce the accumulation of dust and moisture in the air on the twisted section 231 of the bent section 23 of the heat exchange tube 20 of the heat exchanger 100, and can also prevent the heat exchange tube 20 from being squeezed and deformed or from scratching the surface, which is beneficial to improving the reliability of the heat exchange tube.

Figure 5:
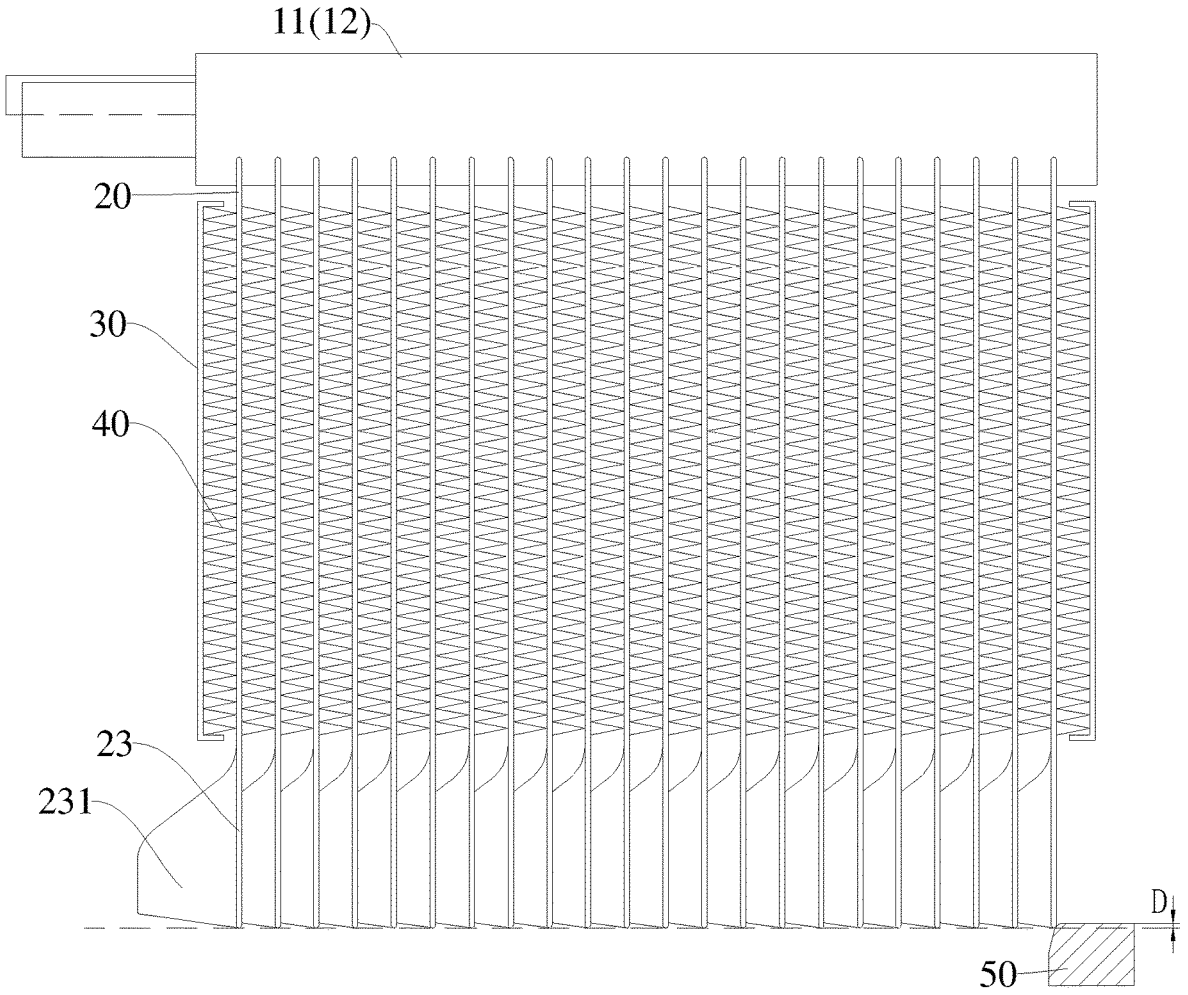
FIG. 5 is a first schematic view of a heat exchanger in a method for processing a heat exchanger according to a first embodiment of the present disclosure.
Figure 6:
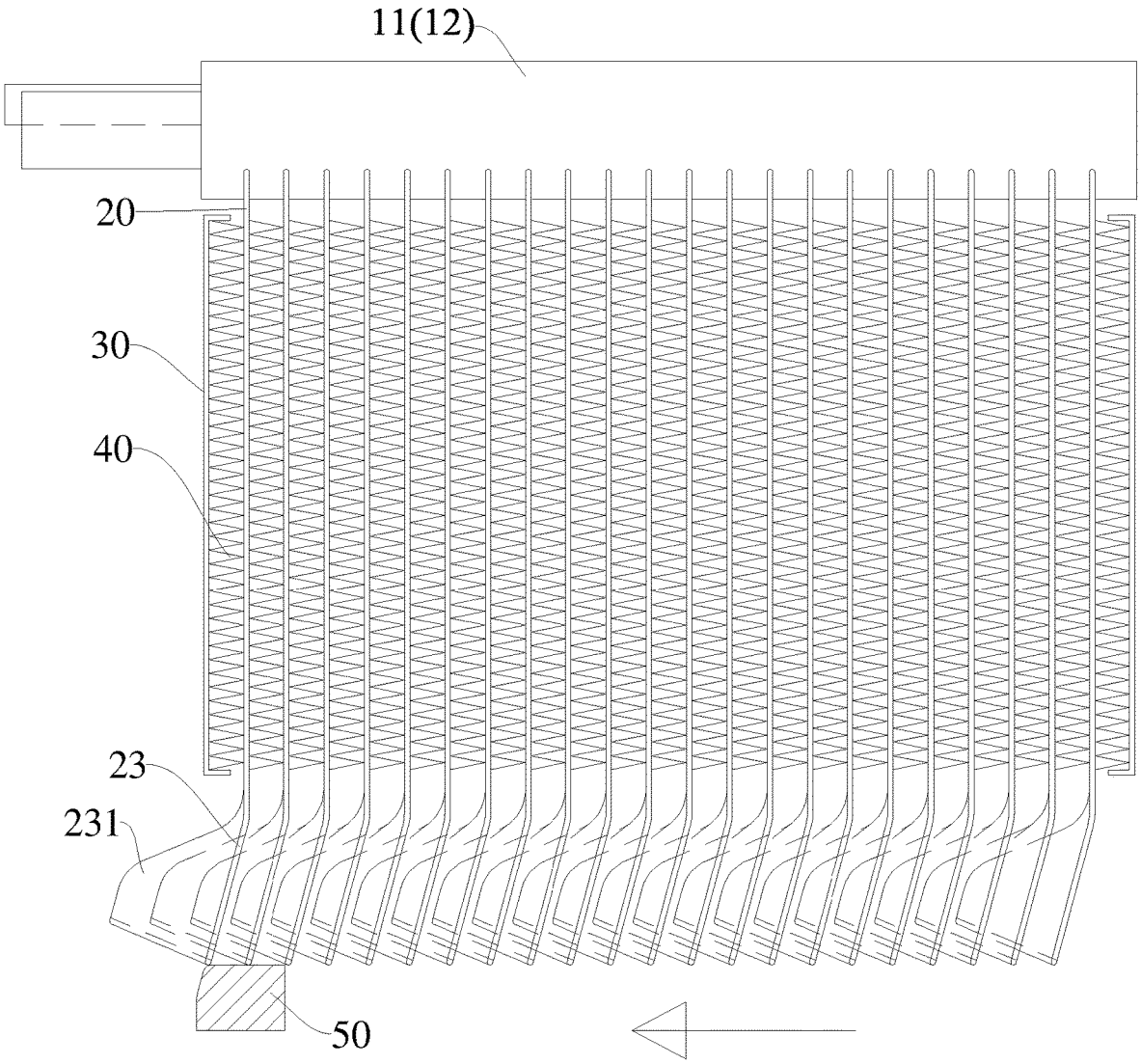
FIG. 6 is a second schematic view of a heat exchanger in a method for processing a heat exchanger according to a first embodiment of the present disclosure.
Figure 15:
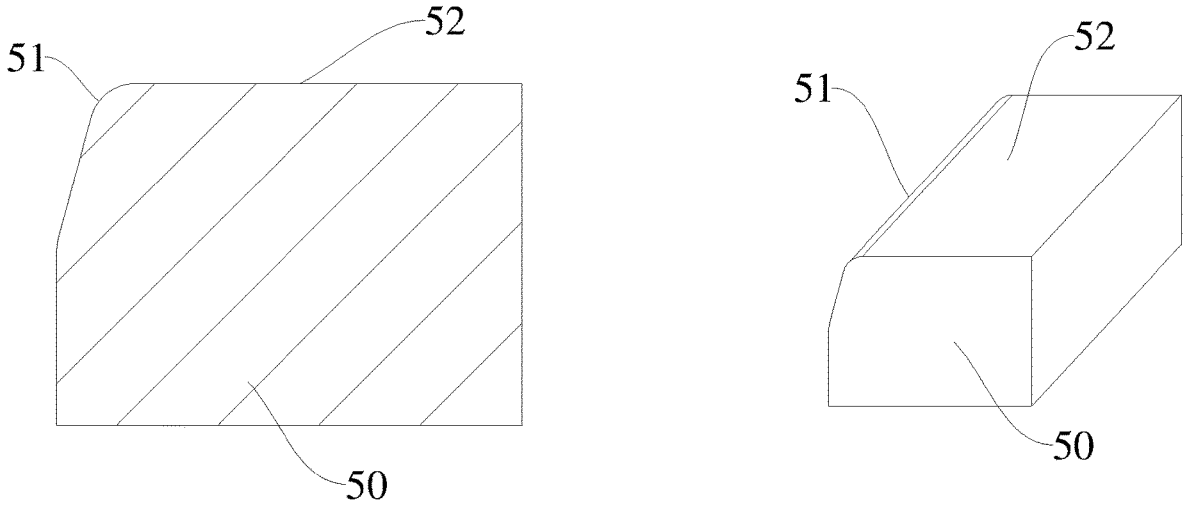
FIG. 15 is a schematic view of a pushing device for processing a heat exchanger according to an embodiment of the present disclosure.

As shown in FIGS. 5, 6 and 15, the pushing member 50 has a circular arc surface 51 and a plane surface 52. The pushing member 50 translates from right to left. During the movement of the pushing member 50, the circular arc surface 51 of the pushing member 50 contacts the third side surface of the bent section 23, thus driving the bent section 23 to rotate by a predetermined angle or move by a predetermined distance relative to the first section 21 connected with the bent section. After the bent section 23 rotates by a predetermined angle or moves by a predetermined distance, an upper plane surface 52 of the pushing member 50 can still contact the bent section 23, which can prevent the bent section 23 from resetting to a certain extent.

In some embodiments, as shown in FIGS. 7-10, 16 and 17, the pushing member 50 of the pushing device for processing a heat exchanger according to embodiments of the present disclosure includes a circular member 501 and a shaft 502. At least a part of an outer peripheral surface of the circular member 501 forms a circular arc surface 51. The circular member 501 has a shaft hole (i.e., a first hole), and the circular member 501 is sleeved on the shaft 502.

As shown in FIGS. 7, 8 and 16, the circular member 501 and the shaft 502 are fixedly connected. The circumferential surface of the circular member 501 is in contact with a part of the bent section 23 of at least one heat exchange tube 20. After the part of the circumferential surface of the circular member 501 contacting the bent section 23 is worn, the circular member 501 can rotate around the axis of the shaft 502 by a certain angle without replacing the pushing member 50, so that the heat exchanger 100 can be processed continuously, the service life of the pushing member 50 can be prolonged, and the processing efficiency can be improved.

As shown in FIGS. 9, 10 and 17, the circular member 501 can rotate relative to the shaft 502 around its axis, and two ends of the shaft 502 are connected with the support member 503. During the movement of the pushing member 50, the circular member 501 rotates around the axis of the shaft 502, and the rotation direction of the circular member 501 is opposite to the rotation direction of the bent section 23 relative to the first section 21 connected with the bent section. It can be understood that the circular member 501 rotates counterclockwise, the pushing member 50 moves from right to left, and the rotation direction of the rotating part is the same as the moving direction of the whole pushing member 50. Therefore, the pushing member 50 can improve the processing efficiency of the heat exchanger 100. In addition, the horizontal pushing force of the pushing member 50 on the heat exchange tube 20 is reduced during movement, and the deformation of the heat exchanger 100 can be improved, that is, the deformation amount of the heat exchanger 100 can be reduced.

In some embodiments, as shown in FIGS. 11, 12 and 18, the pushing member 50 of the pushing device for processing a heat exchanger according to embodiments of the present disclosure includes a circular member 501, a shaft 502 and a protrusion 504.

The circular member 501 includes a circumferential surface and a first hole (not shown). The shaft 502 is located in the first hole, and the circumferential surface of the circular member 501 is symmetrically arranged around the shaft 502. That is, the shaft 502 is engaged with the first hole, and a center line of the shaft 502 is equidistant from all points on the circumferential surface of the circular member 501. In other words, an outline of the projection of the shaft 502 on an end surface of the circular member 501 is a first circle, and the projection of the circumferential surface of the circular member 501 on this end surface is a second circle, and the first circle and the second circle are concentric.

The protrusion 504 is connected with the circumferential surface of the circular member 501 and located at an outer side of the circumferential surface. There is a plurality of protrusions 504, and the plurality of protrusions 504 are circumferentially arranged at intervals along the circumferential surface of the circular member 501. It can be understood that the outer side of the circumferential surface is a side of the circumferential surface facing away from the shaft 502.

When the pushing device for processing a heat exchanger according to embodiments of the present disclosure works, the circular member 501 rotates counterclockwise around the axis of the shaft 502, and the pushing member 50 translates from left to right, that is, the rotation direction of the circular member 501 is opposite to the moving direction of the pushing member 50. During the movement of the pushing member 50, a side of the protrusion 504 of the pushing member 50 contacts the third side surface of the bent section 23.

According to the pushing device for processing a heat exchanger in embodiments of the present disclosure, during a translation of the pushing member 50, the rotation angle or moving distance of the bent section 23 of each heat exchange tube 20 is equal, which is beneficial to improving the aesthetic appearance of the heat exchanger 100; and the heat exchange tube 20 is not pushed in the horizontal direction, which can improve the deformation of the heat exchanger 100, that is, the deformation amount of the heat exchanger 100 can be reduced.

In the description of the present disclosure, it should be understood that the orientation or positional relationship indicated by the terms "center", "longitudinal", "transverse", "length", "width", "thickness", "up", "down", "front", "back", "left", "right", "vertical", "horizontal", "top", "bottom", "inside", "outside", "clockwise", "counterclockwise", "axial", "radial" and "circumferential" and the like, is based on the orientation or positional relationship shown in the attached drawings, which is only for the convenience of describing the present disclosure and simplifying the description, and does not indicate or imply that the referred device or element must have a specific orientation, and be constructed and operated in a specific orientation, so it cannot be understood as a limitation of the present disclosure.

In addition, the terms "first" and "second" are only used for purpose of description, and cannot be understood as indicating or implying relative importance or implicitly indicating the number of indicated technical features. Therefore, the feature defined as "first" or "second" may explicitly or implicitly include at least one such feature. In the description of the present disclosure, "a plurality of" means at least two, such as two, three, etc., unless otherwise specifically defined.

In the present disclosure, unless otherwise expressly defined, terms such as "install", "couple", "connect", "fix" shall be understood broadly, and may be, for example, fixed connections, detachable connections, or integral connections: may also be mechanical or electrical connections or intercommunication: may also be direct connections or indirect connections via intervening media: may also be inner communications or interactions of two elements. For those skilled in the art, the specific meaning of the above terms in the present disclosure can be understood according to the specific situations.

In the present disclosure, unless otherwise expressly defined and specified, a structure in which a first feature is "on" or "below" a second feature may include an embodiment in which the first feature is in direct contact with the second feature, or may further include an embodiment in which the first feature and the second feature are in indirect contact through intermediate media. Furthermore, a first feature "on", "above", or "on top of" a second feature may include an embodiment in which the first feature is right or obliquely "on", "above", or "on top of" the second feature, or just means that the first feature is at a height higher than that of the second feature, while a first feature "below", "under", or "on bottom of" a second feature may include an embodiment in which the first feature is right or obliquely "below", "under", or "on bottom of" the second feature, or just means that the first feature is at a height lower than that of the second feature.

In the description of the present disclosure, terms such as "an embodiment", "some embodiments", "an example", "a specific example" or "some examples" means that a particular feature, structure, material, or characteristic described in connection with the embodiment or example is included in at least one embodiment or example of the present disclosure. Thus, the appearances of these terms in various places throughout this specification are not necessarily referring to the same embodiment or example of the present disclosure. Furthermore, the particular features, structures, materials, or characteristics may be combined in any suitable manner in one or more embodiments or examples. In addition, without contradiction, those skilled in the art may combine and unite different embodiments or examples or features of the different embodiments or examples described in this specification.

Although embodiments of the present disclosure have been shown and described above, it can be understood that the above embodiments are illustrative and shall not be understood as limitation to the present disclosure, and changes, modifications, alternatives and variations can be made in the above embodiments within the scope of the present disclosure by those skilled in the art.

What is claimed is:

1. A method for processing a heat exchanger, comprising:

providing the heat exchanger, wherein the heat exchanger comprises a first tube, a second tube and a plurality of heat exchange tubes, the plurality of heat exchange tubes communicates the first tube with the second tube, each heat exchange tube comprises a first section, a second section and a bent section, the bent section has a first end connected with the first section and a second end connected with the second section, the bent section of the heat exchange tube comprises a twisted section, the first sections of the plurality of heat exchange tubes are arranged at intervals along a length direction of the first tube, and the second sections of the plurality of heat exchange tubes are arranged at intervals along the length direction of the first tube, before processing of the heat exchanger, the bent section of one heat exchange tube is in contact with at least part of the bent section of another heat exchange tube adjacent to the one heat exchange tube in the length direction of the first tube;

placing a pushing member so that at least part of the pushing member contacts at least part of the bent section of at least one heat exchange tube;

moving the pushing member to drive the bent section to rotate by a predetermined angle or move by a predetermined distance relative to the first section connected with the bent section, and/or moving the bent section of the heat exchange tube so that the bent section rotates by a predetermined angle or moves by a predetermined distance relative to the first section connected with the bent section, so that after the processing, the bent section of one heat exchange tube is not in contact with the bent section of the heat exchange tube adjacent to the one heat exchange tube in the length direction of the first tube.

2. The method according to claim 1, wherein the twisted section is formed by twisting at least part of the bent section of the heat exchange tube relative to the first section of the heat exchange tube, and the pushing member moves to change positions of the pushing member and part of the bent section in the length direction of the first tube.

3. The method according to claim 1, wherein the heat exchange tube comprises a first side surface and a second side surface arranged in a first direction, and the heat exchange tube comprises a third side surface and a fourth side surface arranged in a second direction, and the pushing member contacts a part of the third side surface of at least one bent section during movement to drive the bent section to rotate by the predetermined angle or move by the predetermined distance relative to the first section connected with the bent section.

4. The method according to claim 1, wherein the pushing member contacts a part of the second side surface of at least one bent section during movement, to drive the bent section to rotate by the predetermined angle or move by the predetermined distance relative to the first section connected with the bent section.

5. The method according to claim 1, wherein the pushing member contacts a plurality of bent sections at the same time during movement, to drive the plurality of bent sections to rotate by the predetermined angle or move by the predetermined distance relative to the first sections respectively connected with the plurality of bent sections.

6. The method according to claim 1, wherein the pushing member comprises a rotating part and a shaft, and the rotating part at least partially comprises a circumferential surface, and during movement of the pushing member, the circumferential surface of the rotating part contacts a part of the bent section of at least one heat exchange tube.

7. The method according to claim 6, wherein during the movement of the pushing member, the rotating part rotates around an axis of the shaft, and a rotation direction of the rotating part is opposite to a rotation direction of the bent section relative to the first section connected with the bent section.

8. The method according to claim 6, wherein during the movement of the pushing member, a rotation direction of the rotating part is opposite to a moving direction of the pushing member.

9. The method according to claim 1, wherein the heat exchange tube is a microchannel flat tube.

10. A pushing device for processing a heat exchanger, the heat exchanger comprising a heat exchange tube, the heat exchange tube comprising a first section, a second section and a bent section, the bent section having a first end connected with the first section and a second end connected with the second section, the pushing device being configured to push the bent section of the heat exchange tube to rotate by a predetermined angle or move by a predetermined distance, and the pushing device comprising:

a pushing member, wherein the pushing member comprises an outer surface, and surface hardness of at least part of the outer surface is less than or equal to surface hardness of the heat exchange tube.

11. The pushing device according to claim 10, wherein the outer surface of the pushing member comprises a circular arc surface or an inclined surface, and surface hardness of at least part of the circular arc surface or the inclined surface is less than or equal to surface hardness of the heat exchange tube.

12. The pushing device according to claim 10, wherein the heat exchange tube comprises a first side surface and a second side surface arranged along a first direction, the heat exchange tube comprises a third side surface and a fourth side surface arranged along a second direction, and the pushing member comprises a circular arc surface and a plane surface, the circular arc surface of the pushing member is in contact with the third side surface of the bent section, and the pushing member can drive the bent section to rotate by the predetermined angle or move by the predetermined distance relative to the first section connected with the bent section.

13. The pushing device to claim 10, wherein the pushing member comprises:

a circular member comprising a circumferential surface and a first hole; and a shaft located in the first hole, the circumferential surface being arranged symmetrically around the shaft.

14. The pushing device according to claim 13, wherein the circular member is connected with the shaft, and the circumferential surface of the circular member can contact a part of the bent section of at least one heat exchange tube.

15. The pushing device according to claim 10, wherein the pushing member further comprises:

a plurality of protrusions connected with the circumferential surface and located at an outer side of the circumferential surface, and the plurality of protrusions is arranged at intervals along a circumferential direction of the circumferential surface.

16. The pushing device according to claim 15, wherein the heat exchange tube comprises a first side surface and a second side surface arranged along a first direction, the heat exchange tube comprises a third side surface and a fourth side surface arranged along a second direction, and a side of the protrusion of the pushing member can contact the third side surface of the bent section.

17. The pushing device according to claim 13, wherein the pushing member further comprises a support member, and two ends of the shaft are connected with the support member.

18. The pushing device according to claim 17, wherein the bent section of the heat exchange tube comprises a twisted section, and a plurality of heat exchange tubes is provided, the first sections of the plurality of heat exchange tubes are arranged at intervals along the length direction of the first tube, and the second sections of the plurality of heat exchange tubes are arranged at intervals along the length direction of the first tube; and before processing of the heat exchanger, the bent section of one heat exchange tube is in contact with at least part of the bent section of another heat exchange tube adjacent to the one heat exchange tube in the length direction of the first tube, during movement of the pushing member, the circular member can rotate around the axis of the shaft, and a rotation direction of the circular member is opposite to a rotation direction of the bent section relative to the first section of the heat exchange tube.

19. The pushing device according to claim 10, wherein a position of a top end of the pushing member is higher than a position of a bottom end of the bent section of the heat exchange tube.

20. The pushing device according to claim 19, wherein a distance between the top end of the pushing member and the bottom end of the bent section of the heat exchange tube is greater than or equal to a moving distance of a bottom of the bent section in an up-down direction.

* * * * *